US006764356B2

(12) United States Patent
Becher et al.

(10) Patent No.: US 6,764,356 B2
(45) Date of Patent: Jul. 20, 2004

(54) CONNECTION TERMINAL

(75) Inventors: Michael Becher, Althengstett (DE); Edwin Güttinger, Königsbach-Stein (DE)

(73) Assignee: Thermik Geraetebau GmbH, Pforzheim (DE)

( * ) Notice: Subject to any disclaimer, the term of this patent is extended or adjusted under 35 U.S.C. 154(b) by 0 days.

(21) Appl. No.: 10/131,671

(22) Filed: Apr. 24, 2002

(65) Prior Publication Data

US 2002/0177361 A1 Nov. 28, 2002

Related U.S. Application Data

(63) Continuation of application No. PCT/EP00/10563, filed on Oct. 26, 2000.

(30) Foreign Application Priority Data

Oct. 27, 1999 (DE) ..... 199 51 815
Nov. 9, 1999 (DE) ..... 199 53 954

(51) Int. Cl.[7] ..... H01R 4/48
(52) U.S. Cl. ..... 439/835; 439/188
(58) Field of Search ..... 439/835, 621, 439/188, 507, 890, 511, 510, 512, 513, 620; 307/117, 116; 337/377, 380, 373; 200/51.1

(56) References Cited

U.S. PATENT DOCUMENTS 3,533,054 A * 10/1970 Spriggs et al. ..... 339/221
3,750,082 A * 7/1973 Petersen et al. ..... 338/220
3,826,000 A * 7/1974 Du Rocher ..... 29/630
5,717,257 A 2/1998 Hofsäss
5,864,278 A 1/1999 Becher
5,897,389 A * 4/1999 Ditz et al. ..... 439/188
6,004,159 A * 12/1999 Liang ..... 439/621
6,031,447 A 2/2000 Hofsäss
6,091,316 A 7/2000 Hofsäss

FOREIGN PATENT DOCUMENTS

| | | |
|---|---|---|
| DE | 30 06 311 | 8/1981 |
| DE | 83 34 153 | 3/1984 |
| DE | 85 15 405 | 9/1985 |
| DE | 33 42 395 | 2/1991 |
| DE | 195 06 342 | 5/1996 |
| DE | 196 09 310 | 11/1997 |
| DE | 197 19 788 | 11/1998 |
| DE | 197 48 589 | 9/1999 |
| DE | 197 52 581 | 12/1999 |
| GB | 1 272 775 | 5/1972 |
| GB | 1 540 685 | 2/1979 |

OTHER PUBLICATIONS

Phoenix Contact: "Erste Verbindungstechnik 93/94", Phoenix Contact GmbH, Blomberg, DNR. 895–4/93, pages 116, 117 119.

* cited by examiner

*Primary Examiner*—Alex Gilman
(74) *Attorney, Agent, or Firm*—Harness, Dickey & Pierce, P.L.C.

(57) ABSTRACT

A connection terminal for connecting two lines comprises two clamping blocks for receiving and electrically connecting the lines. A receptacle is provided on the connection terminal into which a temperature limiter having at least two terminal legs is insertable and into which two connection elements project, each connection element being connected at its first end to one of the two clamping blocks and being contacted at its second end to an associated terminal leg of an inserted temperature limiter.

28 Claims, 13 Drawing Sheets

CONNECTION TERMINAL

RELATED APPLICATION

This is a continuation application of International Patent Application PCT/EP00/10563 filed Oct. 26, 2000 published as WO 01/31749.

BACKGROUND OF THE INVENTION

1. Field of the Invention

The present invention relates to a connection terminal for connecting at least two lines, comprising a first clamping block to which a first line can be electrically and mechanically connected and a second clamping block to which a second line can be electrically and mechanically connected.

2. Related Prior Art

Such connection terminals are generally known in the prior art.

These connection terminals are available for example in specialty stores as individual parts and are used for example to connect lamps to electrical lines. For this purpose, such connection terminals normally comprise at least two connection parts each consisting of two clamping blocks of electrically conducting material, which are integrally connected to one another, as well as an insulating casing in which the connection parts are arranged.

Each connection part comprises a retaining through bore as well as threaded bores running transversely thereto. The ends, with their insulation removed, of the lines to be connected are inserted into the retaining bores on either side, and these ends are clamped in the retaining bores by screws screwed into the threaded bores. In this manner, a pair of two lines can be electrically and mechanically coupled by a single connecting part. It is also known to insert several lines at one side in the retaining bore, so that an incoming line can simultaneously be connected with several outgoing lines.

Such connection terminals are generally known as lustre terminals.

On the other hand, such connection terminals are also used for connecting transformers, motors, etc. It is known to configure such connection terminals directly, integrally with the housing of the device to be connected, although the connection terminals can also be formed as separate parts secured to the housing of the electrical device by screws or locking.

It is also known to configure the clamping block not as screw connectors but as insulation displacement connectors, where cutting elements are provided in the retaining bores between which the inserted line is clamped and simultaneously contacted.

A so-called temperature limiter is necessary for safety reasons in numerous electrical devices, which normally comprises a bimetal switch and is connected in series with a supply line of the electrical device, so that the operating current of the electrical device flows through the temperature limiter. The temperature limiter is normally thermally coupled to the electrical device to be protected by the limiter, so that a temperature increase of the electrical device leads to a temperature increase of the temperature limiter.

When the temperature of the electrical device to be protected exceeds an allowable upper limit, a bimetal element disposed in the switch is deformed in a known manner and interrupts the current flow to the electrical device. Depending on the configuration of the temperature limiter, it can be provided with a so-called self-holding function, which ensures that the temperature limiter does not switch on again even after the electrical device has cooled off.

It is also known to provide such temperature limiters with a current dependency, so that they respond additionally or exclusively when a certain current value is exceeded, whereby the electrical device is protected against an excess current.

The mounting of such temperature limiters on an electrical device to be protected, normally by hand, is done independently of the connection of the electrical device itself by means of the above-mentioned connection terminal. Frequently, connecting lines of the temperature limiter must be soldered onto contacts of the electrical device to be protected.

An electrical device is known from DE 195 05 342, in which a receptacle is provided for an encapsulated temperature dependent switching mechanism, which is clamped between an external terminal of the device and a terminal part connected directly to the device. From this document, it is also known to provide a receptacle space at the electrical device into which two connecting elements extend between which the encapsulated temperature dependent switch is clamped. A short circuit plug can also be inserted instead of the temperature dependent switch to test the electrical device during fabrication before mounting the temperature dependent switch.

All of the discussed measures for connecting a temperature dependent switch or temperature limiter to an electrical device to be protected have the disadvantage that they either cannot be automated at all or require complicated manipulations, where, for example, first a short circuit plug is plugged in, removed after testing and then the desired temperature dependent switch is inserted.

SUMMARY OF THE INVENTION

In view of the above, an object of the present invention is to provide a simplified, preferably automated assembly of an electrical device equipped with a temperature limiter, where the solution should have a simple construction.

According to the present invention, this object is essentially solved in that the connection terminal as mentioned at the outset comprises a receptacle into which a temperature limiter comprising at least two terminals, preferably two terminal legs, can be plugged in, and into which two connection elements extend, each being connected at their first end to one of the two clamping blocks and at their second end, preferably automatically, contacting a terminal, preferably an associated terminal leg of a temperature limiter, when plugging in same in the receptacle.

The inventors of the present application have found that surprisingly structural modifications of the connection terminal allow a plug-in contact of the temperature limiter so that a series connection of the temperature limiter between the clamping blocks results by simply plugging in the temperature limiter in the receptacle, so that the temperature limiter can be arranged in series with the supply line of the electrical device. This procedure can be automated, because after wiring the connection element the only additional step is to plug in the temperature limiter. Contacting of the temperature limiter to the connection elements is established for example by the insulation displacement technique, although it is also possible to provide screw clamping means. In this case, after plugging in the temperature limiter in the receptacle, only two screws need be tightened down, which however can also be performed automatically, as is the case with wiring the connection element to the lines.

Furthermore, the new connection element allows a rapid and simple assembly and connection of the temperature limiter by hand, for example when a small lot is to be produced or the devices are produced with a lesser degree of automisation.

The new connection terminal can not only be employed for the protection of transformers, motors, etc., where it is secured to the housing in one way or another, rather it can also be used in various fields where protection by a temperature limiter of a device to be connected is possible retroactively in the simplest manner. For example, it is possible to replace the common lustre terminal on a lighting means with the new connection terminal, which only requires a few hand manipulations. With the new connection terminal including the inserted temperature limiter it is now, for example, possible to protect against overheating lighting means previously unmonitored with respect to their temperature development. As is generally known, the lustre clamps in the housing of the lighting means are frequently arranged directly adjacent to the lamp means, so that an overheating results when the rating of the lamp means is too high, which then leads to an increase in the temperature of the lustre clamp, which can be seen over and again with lustre clamps that are charred or deformed by the effects of heat. If the new connection terminals are used instead of the known lustre clamps, an inadmissibly high temperature has the result that the power supply to the lighting means is shut off by the temperature limiter, so that it cannot be damaged or cause any damage as a result of overheating.

In view of the above, connection terminals of the above-mentioned type are subject of the present invention, which comprise between the two clamping blocks a temperature limiter with any interconnection, also for example by soldering the temperature limiter being connected in series with the clamping blocks. By simply exchanging a lustre clamp or by inserting it into a supply line for this purpose, it is possible with the new connection terminal to equip different electrical devices, even retroactively, with a temperature and/or current monitoring means.

Suitable temperature dependent switches are known from documents DE 196 09 310 A1, DE 197 47 589 A1 and DE 197 52 581, each including arranged within a housing a temperature dependent switching mechanism that can be contacted by means of terminal legs extending from the housing, and that according to the first document mainly shows a dependency from temperature, according to the second document a self-holding function, and according to the third document a current dependency.

It should be mentioned that, in the scope of the present application, "temperature limiter" is, on the one hand, generally to be understood as a temperature dependent switch, which separates an electrical connection when an high temperature and/or excess current arises and which optionally is provided with a self-holding function which prevents a closing of the switch after cooling off, wherein in certain configurations the switch remains open even after shutting off the power source, while in other configurations, the self-holding function is reset when the power supply is turned off and then on again. On the other hand "temperature limiters" is here also to be understood as PTC resistors whose resistance increases with growing temperature, so that a current limitation and, indirectly, a temperature limitation is provided for.

As a matter of course it is also possible to integrate the present connection terminal in power switches or plug sockets, couplings, etc. to prevent an inadmissible heating and/or inadmissible high current through the connected consumers. Advantages result, in particular for use outdoors, for example with a water pump in a pond, a garden lamp or the like, which can be inexpensively and simply protected, also when retrofitted.

In an embodiment, the two connection elements at their second end each comprise a clamp contact for an associated terminal leg of the temperature limiter.

This feature is of advantage with respect to simple assembly, since the temperature limiter must only be plugged in and drawing down of additional screws is not necessary.

According to a further object an interruptable short circuit connection is provided between the two connection elements at their second ends, which preferably is interrupted by an actuator member insertable into the receptacle, this actuator member being either arranged on the temperature limiter or provided as a breaker pin, which is insertable into the receptacle so as not to be removable.

These features are generally of advantage in that the connection terminal can be used without the inserted temperature limiter, where no special short circuit plug need be plugged into the receptacle, but the short circuit connection is provided automatically, so to speak, by the temperature limiter not yet having been inserted.

In this manner, one can decide which temperature limiter is to be assembled just before using the new connection terminal. It is, for example, possible to test the electrical device initially without the temperature limiter and then to plug in the limiter, which also can take place automatically, depending on the specifications just before delivering the device. These measures are also of advantage when the present terminals are used to replace lustre clamps, since the entire wiring and cable connections can first be made and tested before upon choice different temperature limiters can then be inserted. This means that the present connection terminal can be marketed independently of the temperature limiter, where it is naturally also possible to market connection terminals with installed temperature limiters, optionally soldered-in temperature limiters.

A further advantage is that the interruption of the short circuit connection does not require the removal of a short circuit plug or the like, rather it is achieved by an actuator member which can also easily and automatically be inserted. A particular advantage is achieved when the actuator member is arranged on the temperature limiter, as then only a single hand manipulation is necessary to simultaneously interrupt the short circuit connection and install the temperature limiter.

The breaker pin has the further advantage that it fulfills special safety requirements when configured to be non-removable. A connection terminal once having been equipped with a temperature limiter can then no more be operated without the temperature limiter, so that a device supplied with power via the connection terminal and to be protected by the inserted temperature limiter can only be supplied with power when the temperature limiter is in place. Should the temperature limiter fall out or be deliberately removed, the device is no longer be supplied with power, so that a high degree of safety with respect to monitoring of the temperature and current is guaranteed. The breaker pin can, for example, be locked in the receptacle for this purpose.

According to a further object, the breaker pin is insertable into the receptacle in a force fit, which can be achieved for example when it has a zero tolerance or a slightly larger dimension with respect to the receptacle.

In this very simple constructive manner, it is ensured that the breaker pin cannot be removed or removed only by destroying the connection terminal.

It will be understood however that the temperature limiter can be exchanged, should it be defective or be exchanged with another temperature limiter with other specifications, for example another response temperature.

It is a further object that the short circuit connection comprises a short circuit element clamped between the connection elements and being movable to an open position by the actuator member.

Also this feature is constructively preferred as it is only necessary to provide a resilient part on one connection element, which is biased onto the other connection element and lifted thereoff by the actuator member. The resilient part can be broken or broken off by the actuator member, so that reestablishing the short circuit connection is excluded. Alternatively, it is also possible to provide the short circuit means as a connector block, which is pushed out of the gap between the two connection elements by the actuator member and optionally urged into a clamp seat from which it cannot be removed, so that an inadvertent closing of the short circuit connection is not possible.

It is a further object that the two connection elements each comprise at least one resilient element and the two resilient elements contact one another to establish the short circuit connection and can be separated from one another by the actuator member.

This has the advantage that two resilient elements contribute to the quality of the short circuit connection, so that a very reliable short circuit connection exists between the clamping blocks before inserting the temperature limiter.

According to a further object each resilient element comprises a first contact region through which it forms the short circuit connection with the first contact region of the other resilient element, and a second contact region through which it contacts an associated terminal leg of a temperature limiter when inserted in the receptacle.

Also this measure is constructively advantageous because each connector element requires only one resilient element which establishes either the short circuit connection or the contact to the temperature limiter. A further advantage apart from the simple construction is that an inserted temperature limiter cannot be bypassed again by inadvertently closing the short circuit connection because the resilient elements can only contact one another or the terminal legs of the temperature limiter.

According to a further object the two connection elements at their respective first end are spring biased into contact with the respective clamping block, where preferably at least one of the clamping blocks comprises a retaining bore for receiving a line as well as a threaded hole running transversely to the bore for a screw for clamping the line in the retaining bore, where preferably the two connection elements on their respective first ends comprise an up-standing resilient wing, which extends approximately parallel to the respective screw and is spring biased onto the screw.

These measures are advantageous in that convential clamping blocks can be used, as are known from the common lustre clamps. Contact results through the connection elements which are either resiliently urged onto the clamping block itself or are urged with their wing onto the clamping screw for the line. An advantage of the wing is also that it can compensate for different geometries of the screw, where the contact further is not impaired when lines of different thickness are clamped in the retaining bore, i.e. when the screw is screwed into the threaded hole at different depths to clamp the line or lines.

It is another object that the connection terminal comprises at least one connection part having two clamping blocks directly connected to one another, through which two further lines can be directly connected to one another.

The advantage is that the present connection terminal can connect two lines directly with one another, while two further lines are connected to one another in series connection with the temperature limiter. The inventors of the present application have found that it is not necessary to provide a temperature limiter in every supply line of the electrical device, although this can naturally be of advantage in certain requirement circumstances, for example when a current dependent temperature limiter without the self-holding function and additionally a temperature limiter responding solely to high temperatures with self-holding function are to be used simultaneously.

According to a further object the connection terminal comprises an insulating casing in which the first and second clamping blocks are arranged at a first side and the connecting part is arranged at a second side and the receptacle is arranged between the two sides.

This allows a geometry such that the temperature limiter is located so to speak in the middle of the connection terminal, where naturally a location at the side is also possible.

According to another object the connection terminal comprises an insulating casing having a first casing section receiving the first and second clamping block and at least one second casing section receiving the at least one connection part, where a flexible spacer is provided between the two casing sections such that the two casing sections are variable in their spacing laterally to one another.

This measure has the advantage that the new connection terminal can also be used to connect at least two pairs of lines, where at least the lines on one side of the connection terminal have a fixed distance between one another with certain tolerances. Due to the fact that the spacing of the clamping blocks laterally with respect to one another can be varied within certain limits, the new connection terminal can be applied to lines whose spacing changes with respect to one another due to the accuracy in fabrication or due to different designs. In the simplest case, flexible or elastic bridges are formed between the casing sections, which are configured to have a zig-zag form, meander form, a wave-like form or the like. In a preferred embodiment, two bridges are provided to form a diamond, where the diamond allows an increase or decrease of the lateral spacing.

With a connection terminal being also subject of the present invention, i.e. having a temperature limiter with arbitrary interconnections between two clamping blocks to which it is connected in series, it is preferred that the temperature limiter comprises two terminal legs that are directly electrically connected at their respective free ends to a respective one of both clamping blocks.

It is an advantage of this measure that it is constructively very simple; both connection elements may be dispensed with if the connection terminal is durably equipped with a temperature limiter.

It is a further object that at least one terminal leg comprises at its free end a fish joint strip that contacts the associated clamping block from the outside.

Here, the simple and safe assembly is advantageous, particularly if the fish joint strip is clamped between the clamping block and an inner wall of a channel of the connection terminal wherein the channel receives the clamping block. Here it is merely necessary to attach a temperature limiter after the clamping block has been inserted into the channel, whereby the fish joint strip slides between the clamping block and the channel wall and gets clamped in this position.

On the other hand, it is an object that at least one terminal leg comprises at its free end a connector eyelet that is connected with the associated clamping block by a screw being provided for clamping one of both lines.

This measure results in a very safe electrical connection between the clamping block and the terminal leg, particularly in those cases wherein the connector eyelet has a smaller diameter than the core diameter at the screw bolt so that the screw screws or even cuts into the connector eyelet and ensures in this way a safe electrical connection between the connector eyelet and the screw. The screw is screwed simultaneously into the clamping block where it is used for clamping a line. Independent from the thickness of the line, the electrical connection between the clamping block and the temperature limiter via the screw is guaranteed, the screw being electrically conductive and being connected on the one side with the clamping block and on the other side with the connector eyelet.

It is also an object that both clamping blocks are arranged along a longitudinal axis one after another and the temperature limiter is received in a frontal receptacle extending transversely to the longitudinal axis.

This measure is advantageous in that the temperature limiter can be thermally coupled to a device to be monitored in a very effective manner. If the electrical device to be monitored is, for example, an electrical motor winding, the clamping block can be directly attached with its front end onto the windings, whereby the temperature limiter is electrically isolated from the windings merely by the outer wall of the casing of the connection terminal, but apart from that the temperature limiter is in close thermal connection to the windings. Thus an effective and fast response is provided for.

The invention further relates to an electrical device provided with a new connection terminal, where the connection terminal is fixed to the housing of the electrical device or alternatively, the connection terminal is formed integrally with the housing.

Further, the invention relates to a temperature limiter with an actuator member arranged thereon or an actuator member independent of the temperature limiter for use in the new connection terminal.

Further advantages and features will become apparent from the following description and the attached drawings.

It will be understood that the above-mentioned features and those to be discussed below are not only applicable in the given combinations but may also be used in other combinations or taken alone without departing from the scope of the present invention.

BRIEF DESCRIPTION OF THE DRAWINGS

Embodiments of the invention are shown in the attached drawings and will be discussed in more detail below. In the drawings.

DETAILED DESCRIPTION OF THE PREFERRED EMBODIMENT

Figure 1:
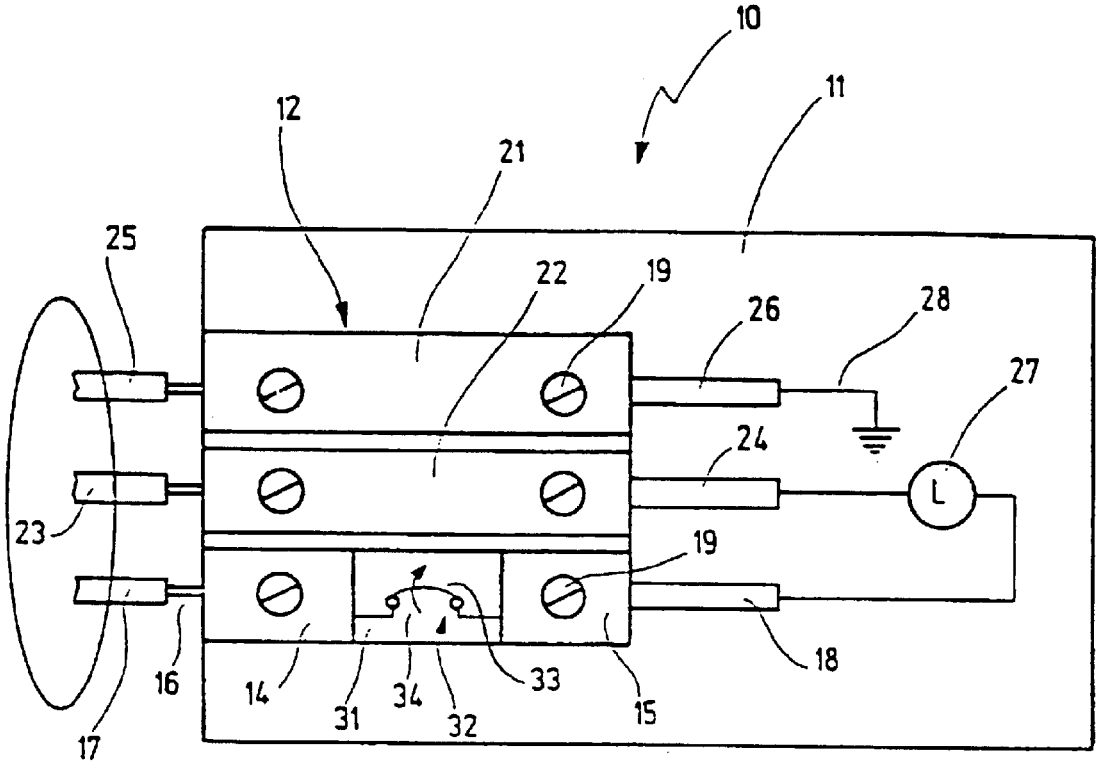
FIG. 1 shows a schematic plan view of an electric device with a new connection terminal.

In FIG. 1 with the reference numeral 10, an electrical device 11 is shown schematically, a connection terminal 12 being secured on the also schematically indicated housing 11 of the electrical device.

The connection terminal 12 comprises a first clamping block 14 and separated therefrom a second clamping block 15. A line 17 is inserted into the clamping block 14 from the left side with its end 16 having the insulation been removed while a line 18 is inserted from the right side into the clamping block 15. The lines 17, 18 are mechanically and electrically connected to the clamping blocks 14, 15 through screws 19 as is known per se.

Two connection parts 21, 22 are insulatedly arranged adjacent the clamping blocks 14, 15, each connection part comprising two clamping blocks connected to one another so to speak integrally, so that lines 23, 24 or lines 25, 26 are mechanically received and held and are electrically connected to one another.

The connection terminal 12 so far corresponds to the common lustre terminal through which external lines 17, 23, 25 can be connected to internal lines 18, 24, 26 of an electrical device 10, a substantial difference being that the clamping blocks 14, 15 are not formed integrally with each other but are arranged isolated from one another.

It is also noted that an electric consumer 27 is connected between the lines 18, 24 and indicated as a load L. The line 26 is connected to ground 28.

A receptacle 31 for a temperature limiter 32 is provided between the clamping blocks 14, 15, as described for example in the above-mentioned documents. Only as an example, the temperature limiter is indicated in FIG. 1 as to comprise a bimetal spring 33, which when heated is deformed in the direction of an arrow 34. As long as the bimetal spring 33 is in the position shown in FIG. 1, it provides for an electrical connection between the clamping blocks 14, 15 and thus for a possible current flow from line 17 over line 18 and to the consumer 27 and from there back via line 24, connection part 22, and line 23.

As mentioned above, a protection of the consumer 27, i.e. the device 10, against high temperatures and/or excessive current is achieved by the temperature limiter 32. The connection terminal 12 can be an integral part of the housing 11 or can be fixed to the housing 11 with screws or locking means. However, it is also possible to place the connection terminal 12 directly in a line, optionally a multi-wire line, without the connection terminal being mechanically fixed to the housing 11.

Figure 2:
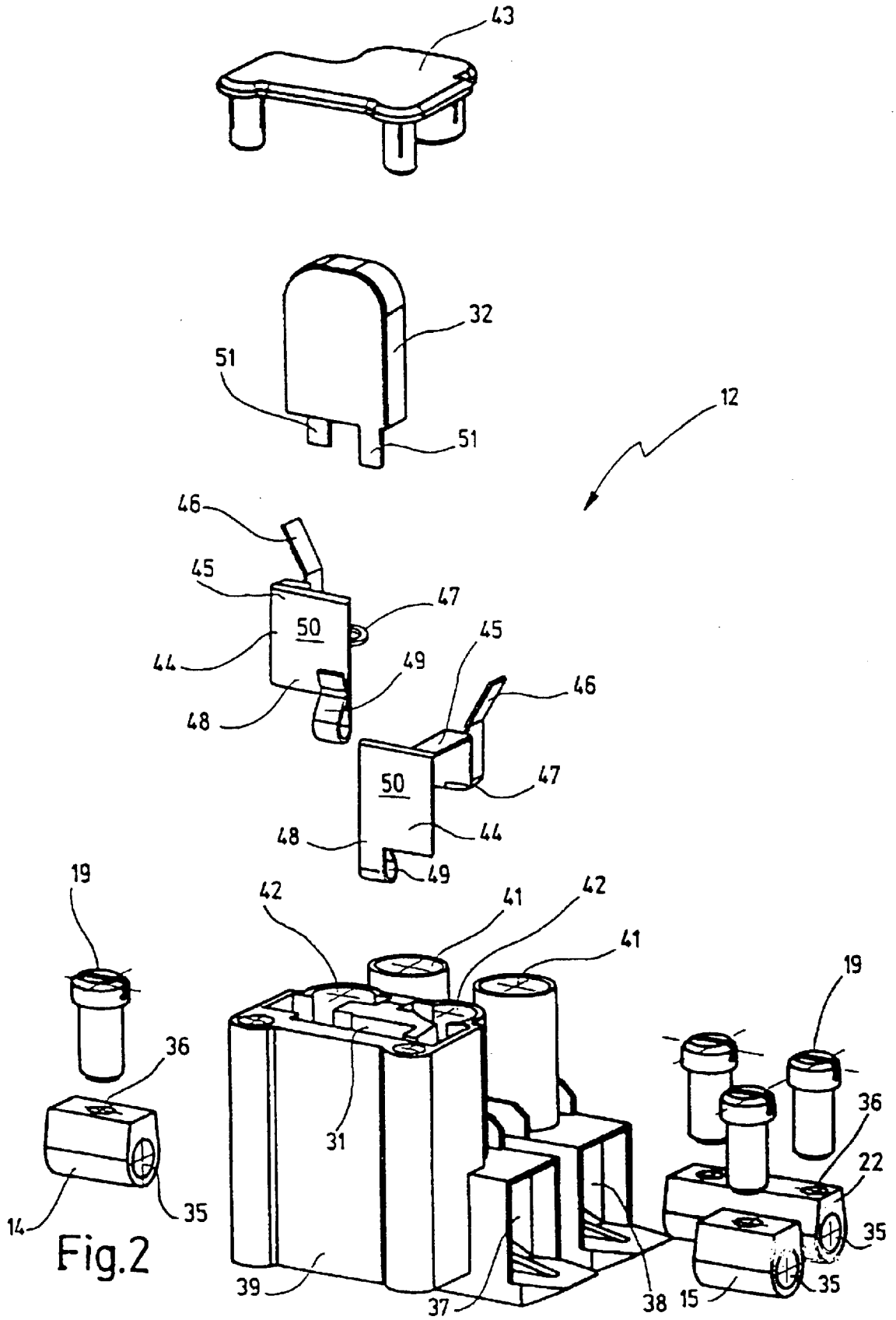
FIG. 2 shows a perspective exploded view of the connection terminal of FIG. 1 in a first embodiment.

The connection terminal 12 of FIG. 1 is illustrated in FIG. 2 in a schematic and exploded representation. In FIG. 1 it can be seen first of all that in known manner the clamping blocks 14, 15 as well as the connection part 22 comprise retaining through bores 35 along the longitudinal axis, threaded holes 36 running transversely to the bores 35, in which threaded holes screws 19 can be screwed to clamp and electrically contact the lines inserted into the retaining bores 35. It will be understood that it is also possible to use insulation displacement clamps instead of the known screw clamps, which do not require screws but have cutting teeth in the retaining bores 35 for mechanical retention and electrical contact with the lines.

The clamping blocks 14, 15 as well as the connection part 22 are inserted in channels 37, 38, which are arranged in elongated, block-like sections 37*a*, 38*a* of an insulating casing 39. A cuboid 40 is formed at the casing section 37*a* of the channel 37 in which the receptacle 31 is provided.

In addition, the insulating casing 39 comprises screw holes 41, 42 running transversely to the channels 37, 38 through which the screws can be screwed into the threaded holes 36 after the clamping blocks 14, 15 as well as the connecting part 22 are inserted into the corresponding channels 37, 38. It is thus prevented that the clamping blocks 14, 15 as well as the connecting part 22 can fall out of the channels 37, 38 again.

A cover 43 is also shown at the top in FIG. 2, which closes the receptacle 31 on the upper side after the temperature limiter 32 together with the connection elements 44 to be discussed below have been inserted.

Each connection element 44 comprises an upward standing, resilient wing 46 at its first end 45, which extends parallel to the respective screw 19 and is resiliently biased onto the screw. A contact ring 47 is also provided between the wing 46 and the first end 45, through which ring the screw 19 is passed to hold the connection element 44 in the receptacle 31.

The connection element 44 comprises a clamp contact 49 at its second end 48, which lies in a plane with a base plate 50 of the connection element 44, the first end 45 extending transversely from the base plate.

When the two connection elements 44 have been inserted into the receptacle 31, they contact the screws 19 and thus the clamping blocks 14 and 15 through their first ends 45 or the respective wing 46 and contact ring 47. With their second ends 38, the connection elements 44 with their clamp contacts 49 are contacted with terminal legs 51 of the temperature limiter, the terminal legs 51 being passed into the U-shaped clamp contacts 49 when the temperature limiter 19 is inserted into the receptacle 31.

Except for the temperature limiter 32, the connection terminal 12 can be preassembled and already wired to the electrical device, before then a suitable temperature limiter 32, depending on the desired cut-off temperature and/or cut-off current, is inserted into the receptacle 31, preferably with an automatic handling device. If desired, the receptacle 31 can then be closed with the cover 43.

Figure 3:
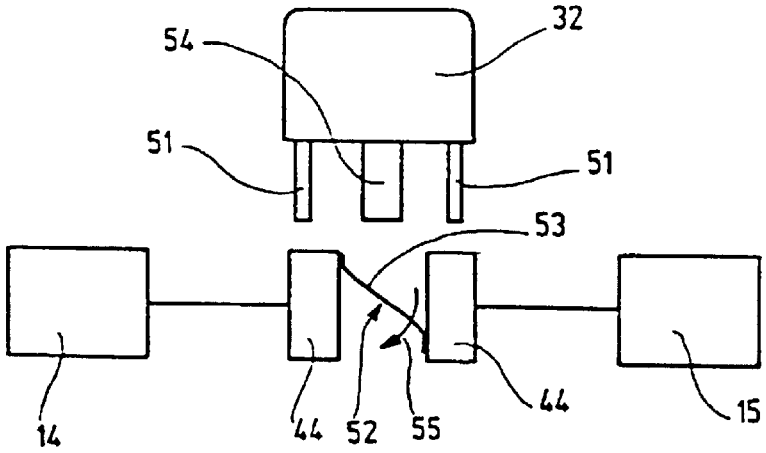
FIG. 3 shows a schematic side view of the new connection terminal in a second embodiment with a short circuit arrangement.

The connection terminal 12 of FIG. 1 is shown in a second embodiment in FIG. 3, where a short circuit connection 52 in the form of a resilient short circuit element 53 is provided between the schematically indicated connection elements 44. In this manner, the clamping blocks 14, 15 are conductively connected to one another when no temperature limiter 32 is inserted in the receptacle 31.

An actuator member 54 is provided on the temperature limiter 32 and pushes the resilient short circuit element 53 in the direction of an arrow 55 away from the right connection element 44, so that the short circuit connection 52 is interrupted. When inserting the temperature limiter 32, its legs 51 engage with the connection elements 44, which aside from the clamp contacts shown in FIG. 2 can also be formed as insulation displacement clamps or screw clamps.

Figure 4:
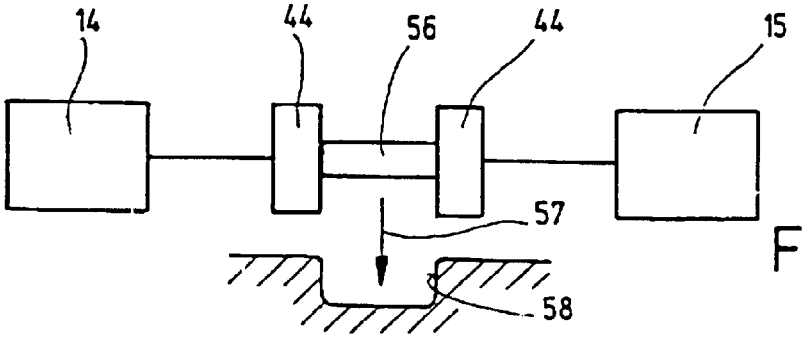
FIG. 4 shows an illustration as in FIG. 3, however with another embodiment of the short circuit arrangement.

A similar construction to FIG. 3 is shown in FIG. 4, however, the short circuit connection 52 is formed as a short circuit block 56 which is pushed by the actuator member 54 in the direction of an arrow 57 out of the space between the connection elements 44 into a clamp pocket 58, where it is held in captive manner.

While in the embodiment of FIG. 3, if need be, the short circuit connection 52 is closed again when the temperature limiter 32 is withdrawn, the interruption of the short circuit connection 52 in FIG. 4 is irreversible, which is frequently desired when greater safety is required. Namely, when the short circuit connection 52 is not closed after the temperature limiter is removed or inadvertently falls out, then it is ensured that an "unprotected" operation of the electrical device is not possible.

Figure 5:
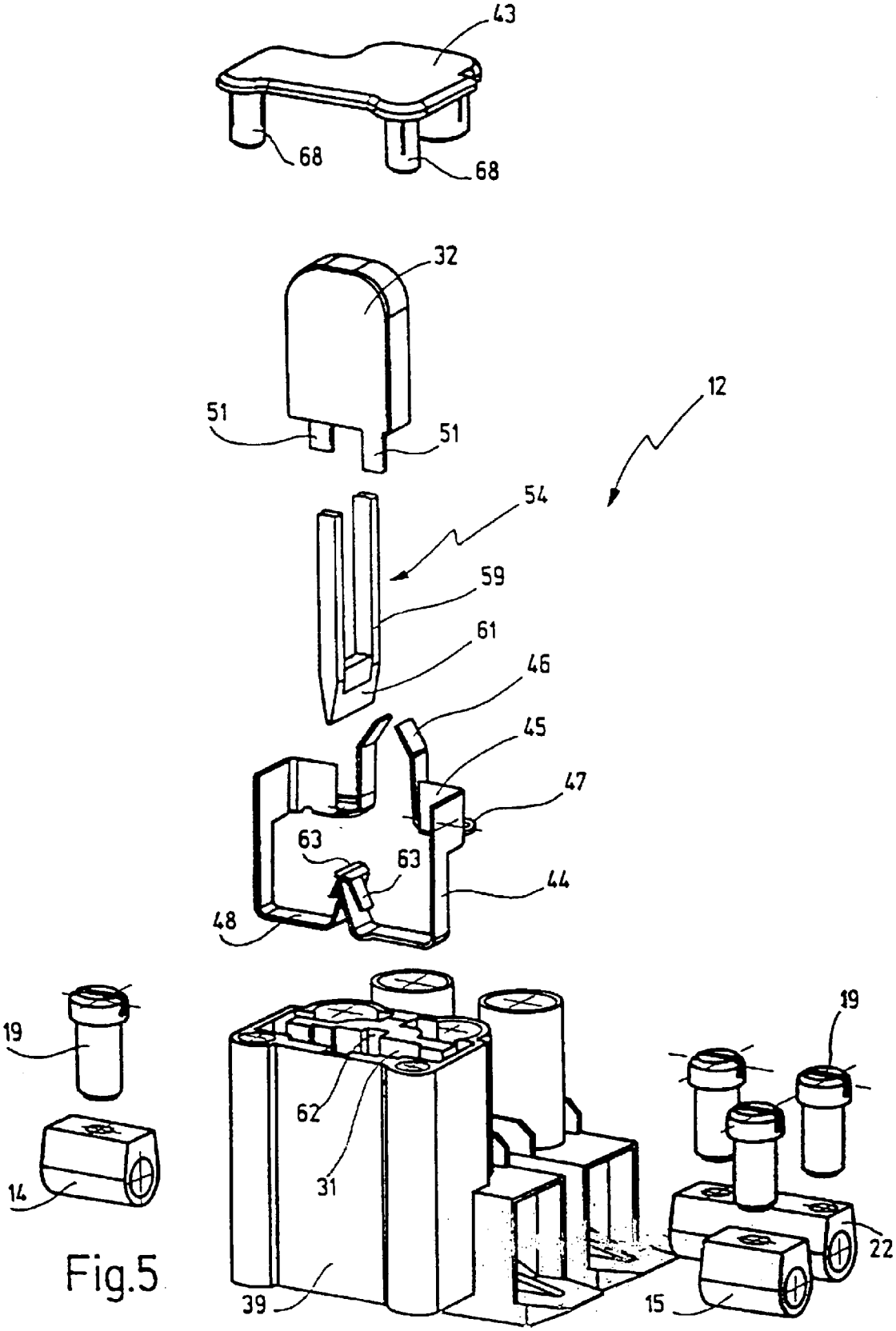
FIG. 5 shows a schematic exploded representation as in FIG. 2, however in an embodiment with a short circuit arrangement.

Similarly to FIG. 2, FIG. 5 shows an embodiment of the connection terminal where the actuator member is provided as a breaker pin 59 with an arrow head 61, which is separate from the temperature limiter 32. A guide channel 62 is provided in the receptacle 31 for the breaker pin 59, which channel runs transversely but parallel to the longitudinal axis of the receptacle 31 and captively holds the breaker pin 59 in a force fit connection.

Each connection element 44 is configured at its first end 45 as with the connection terminal 12 of FIG. 2, in the region of its second end 48, each connection element 44 however comprises a U-shaped spring element 63, which forms the short circuit connection 52 and also provides contact to the terminal legs 51 of the temperature limiter 32.

Figure 6:
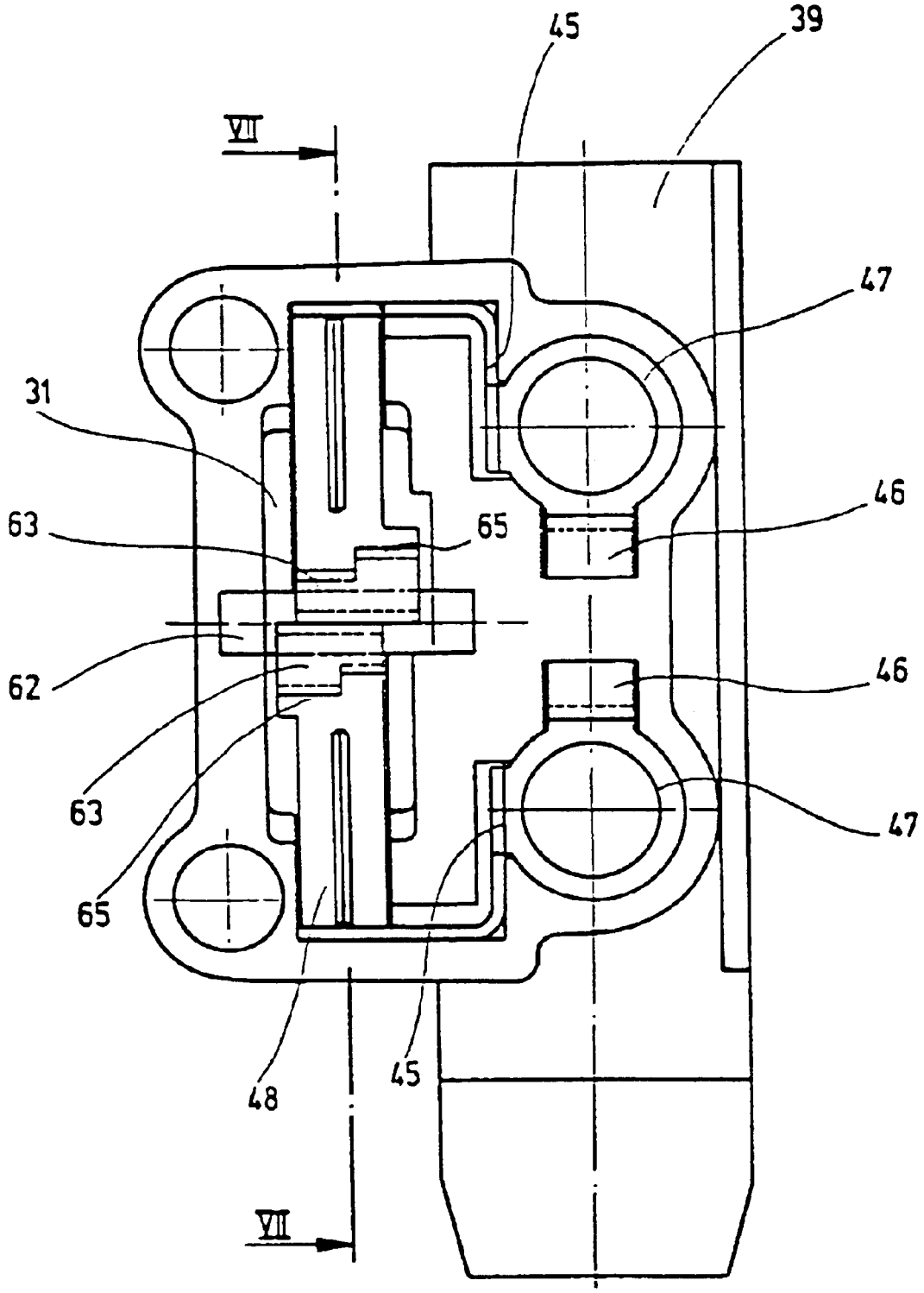
FIG. 6 shows a plan view of the connection terminal of FIG. 5, but only in the region of the receptacle and the separated clamping blocks.

FIG. 6 shows a plan view of the connection terminal 12 of FIG. 5, where the region associated with the connection part 22 is left out for simplification. It is also contemplated that the connection terminal 12 can be configured without the connection part 22, the insulating casing 39 then having a more narrow construction.

As can be seen in the plan view of FIG. 6, each connection element 44 again comprises the wing 46, the contact ring 47 and now also the two spring elements 63. The guide channel 62 for the breaker pin 59 extends transversely to the spring element 63.

Figure 7:
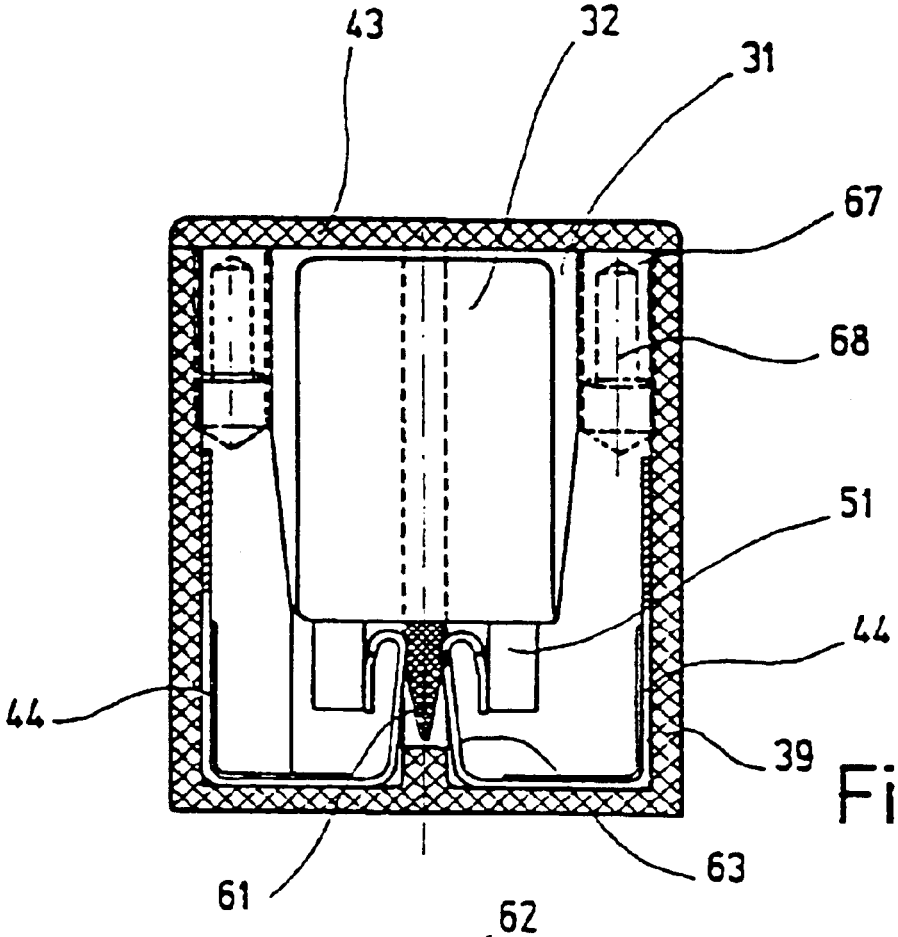
FIG. 7 shows a cross-sectional view of the connection terminal of FIG. 6 along the line VII—VII in FIG. 6 but with inserted temperature limiter.

FIG. 7 shows a cross-section along the line VII—VII in FIG. 6, where a temperature limiter 32 is inserted into the receptacle 31. As can be seen in FIG. 7, the arrow head 61 urges the two spring elements 63 apart from one another, so that the short circuit connection is opened, however contact is established to the terminal legs 51 of the temperature limiter 32 at the same time.

Figure 8:
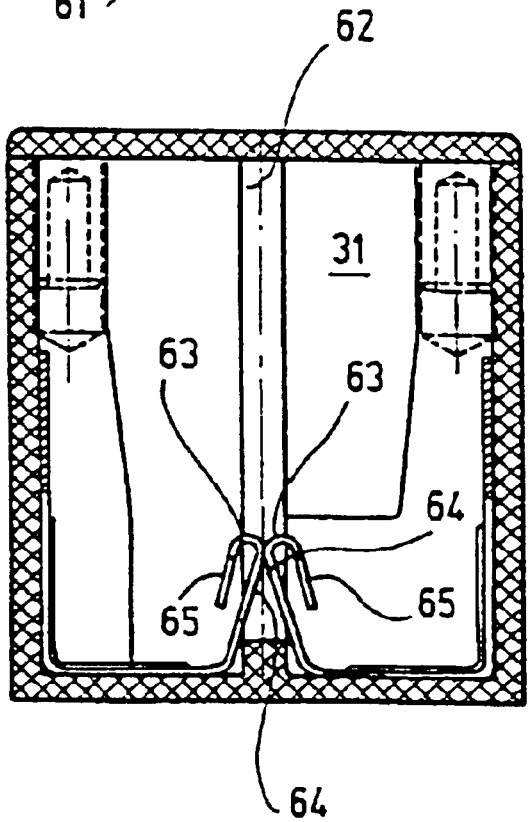
FIG. 8 shows a view as in FIG. 7 but without temperature limiter.

In FIG. 8, an illustration as in FIG. 7, but without temperature limiter 32, one can see that each U-shaped spring element comprises a first contact region 64 and a second contact region 65. In the position shown in FIG. 8, the first contact regions 64 of the spring elements 63 contact one another and thus form a short circuit connection, which directly connects the two clamping blocks 14, 15 with each other.

If the breaker pin 39 is now inserted, its arrow head 61 pushes the two spring elements 63 apart and the short circuit connection is broken. The temperature limiter 32 is inserted simultaneously with the breaker pin 59 or shortly thereafter, the terminal legs 51 of the temperature limiter 32 then resting against the two contact regions 65 of the spring elements 63.

Returning to FIG. 6, it can be seen that the two contact regions 65 are displaced with respect to one another in the plane of the drawing of FIG. 6. This accounts for the arrangement of the terminal legs 51, which are also displaced as can also be seen in FIG. 5.

Figure 9:
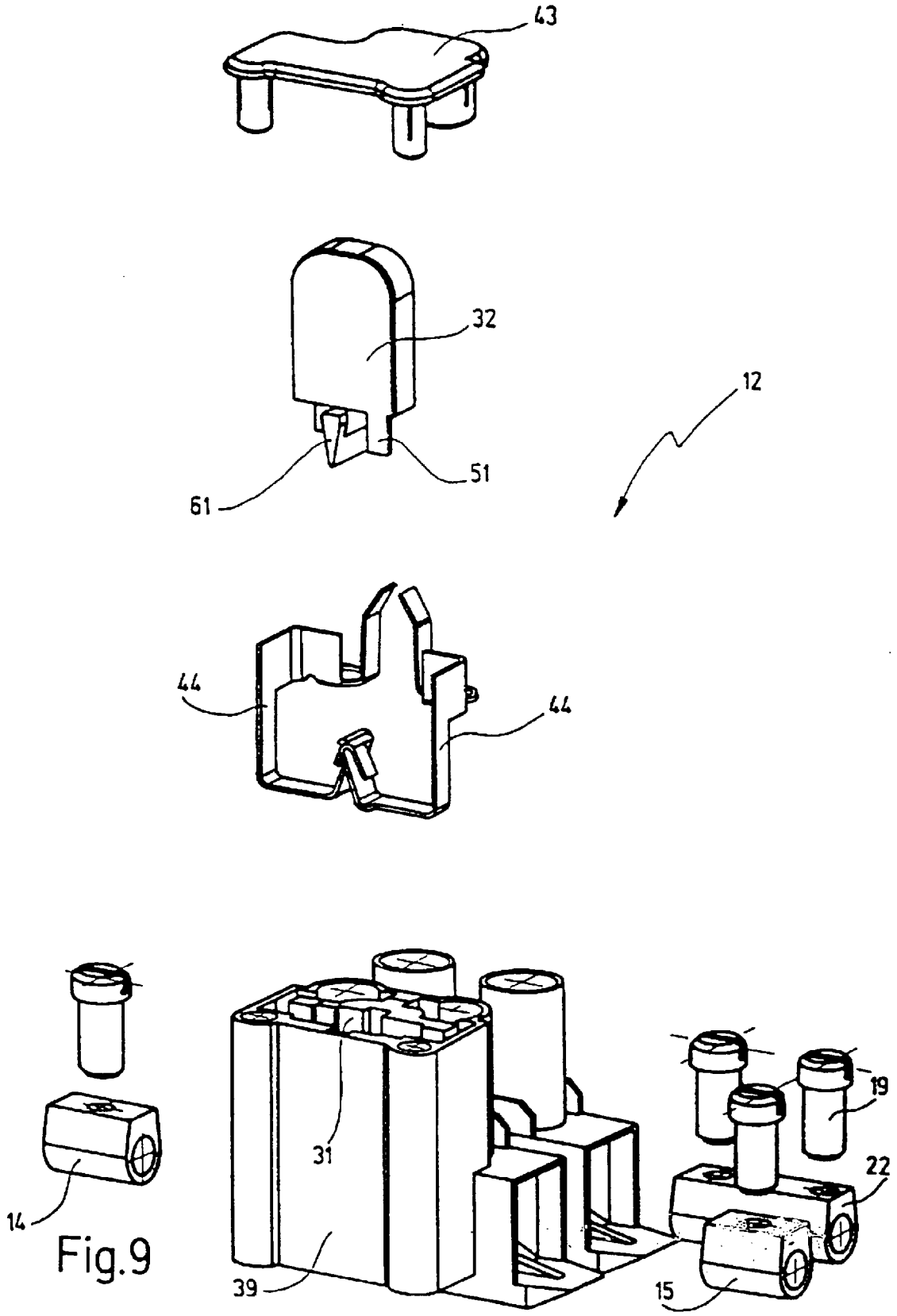
FIG. 9 shows a schematic exploded view as in FIG. 5 with an actuator member fixed to the temperature limiter.

While standard temperature limiter 32 can be employed in the embodiment of FIG. 5, in the embodiment of FIG. 9 a temperature limiter 32 is employed having the arrow head 61 arranged directly thereon. Otherwise, the connection terminal 12 of FIG. 9 corresponds to the embodiment of FIG. 5.

In FIGS. 7 and 8, bushing 67 and pin 68 can be seen below the cover 43, through which the cover 43 is secured to the insulating casing 39.

Figure 10:
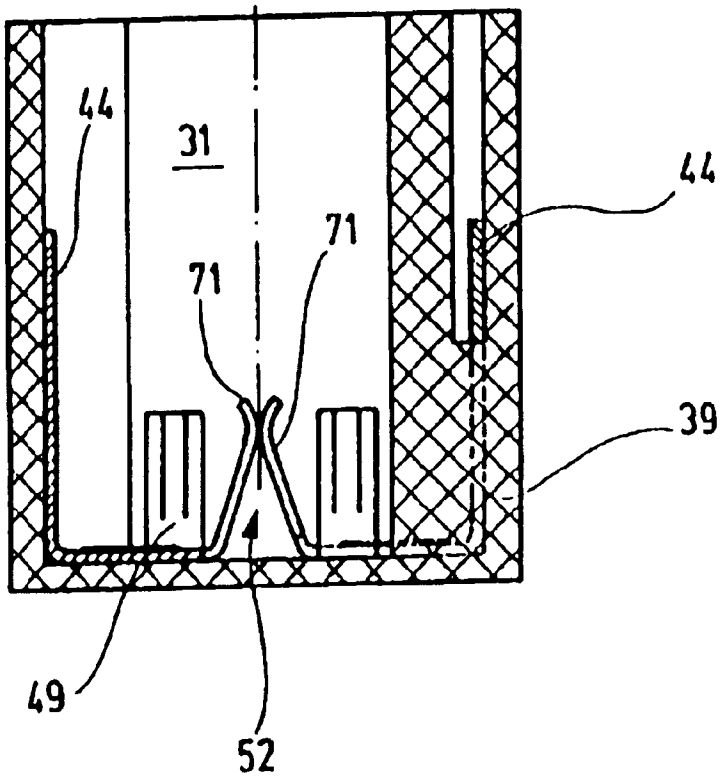
FIG. 10 shows a cross-sectional view of a connection terminal in a third embodiment seen along the line X—X in FIG. 13.
Figure 12:
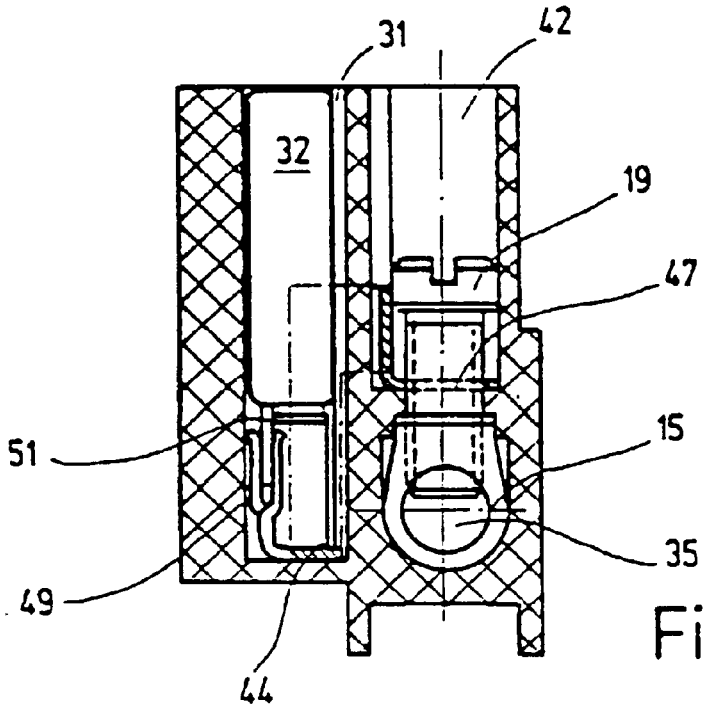
FIG. 12 shows a cross-sectional view of the temperature limiter in FIG. 13; seen along the line XII—XII of FIG. 13.
Figure 13:
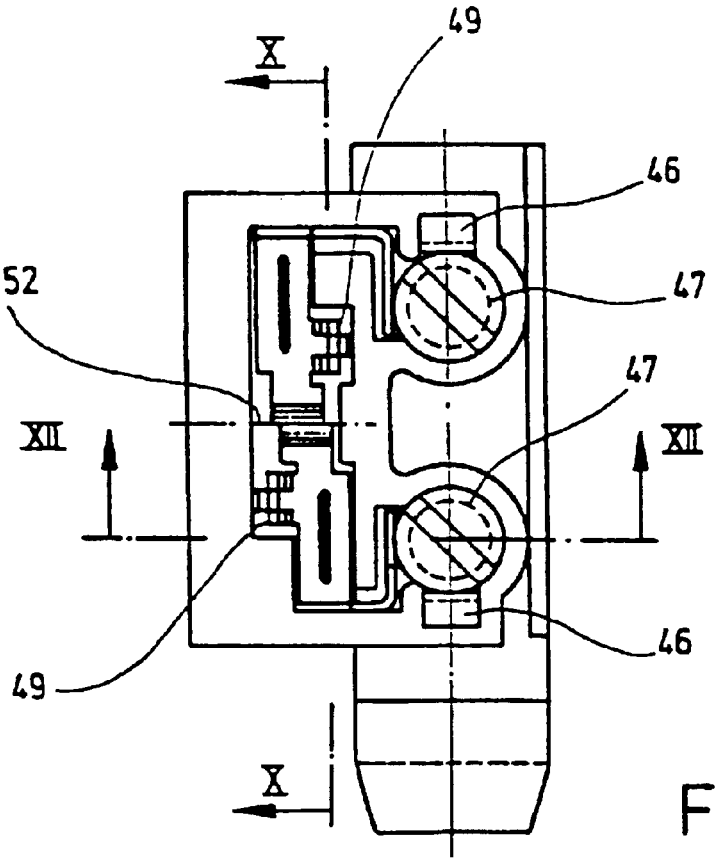
FIG. 13 shows a plan view of a connection terminal in a fourth embodiment.

While in the embodiments of FIGS. 5 and 9, the spring elements 63 provide for both the short circuit connection 52 and also for the contact to the terminal legs 51 of the temperature limiter 32, in the embodiments of FIGS. 10 to 13 the connection elements 44 are comparable to the spring elements of FIG. 2, where the contact to the terminal legs 51 takes place through the U-shaped clamp contacts 49. In addition, the connection elements 44 in FIGS. 10 to 13 comprise spring brackets 71 which contact one another when the temperature limiter 32 is not inserted and thus form the short circuit connection 52, as shown in FIG. 10.

Figure 11:
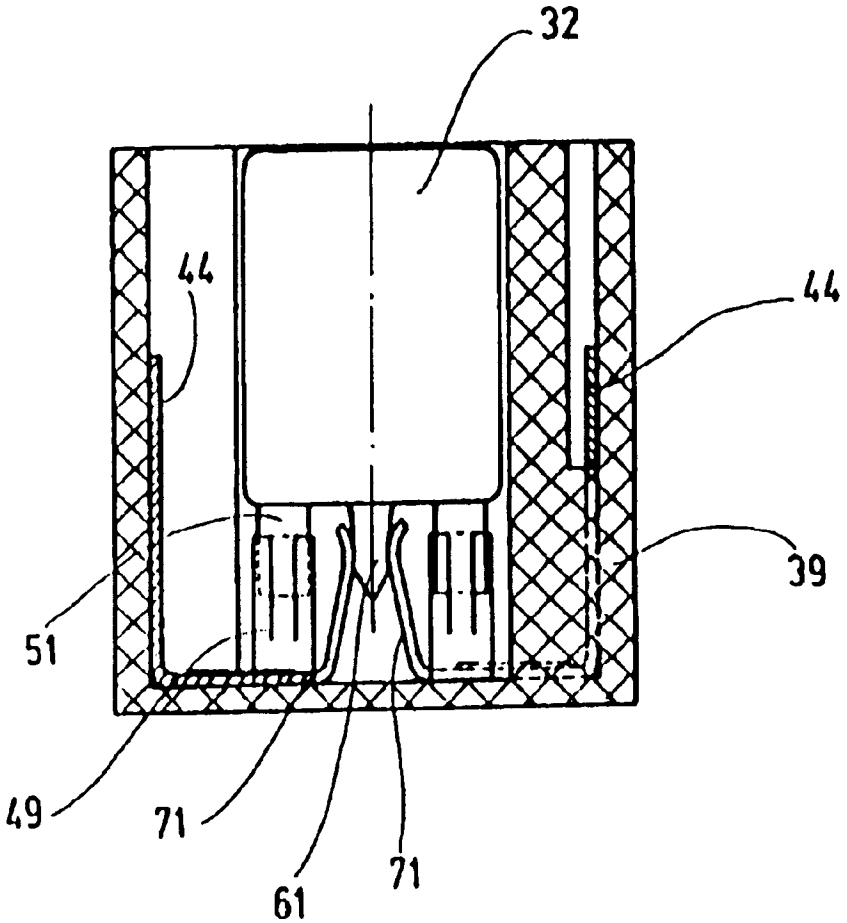
FIG. 11 shows a view as in FIG. 10 but with a temperature limiter inserted.

As can be seen from FIG. 11, an inserted temperature limiter 32 with the arrow head 61 in this case fixed thereto pushes apart the spring brackets 71, so that the short circuit connection 52 is interrupted. At the same time, the terminal legs 51 engage in the clamp contacts 49 as can best seen in the cross-sectional view of FIG. 12. In this view it can also be seen how the screw 19 sits in the screw hole 42, the screw being connected to the connection element 44 by the contact ring 47. The wings 46 can be seen in the plan view of FIG. 13. The displaced arrangement of the two clamp contacts 49 as well as the centrally formed short circuit path 52 can also be seen here.

Figure 14:
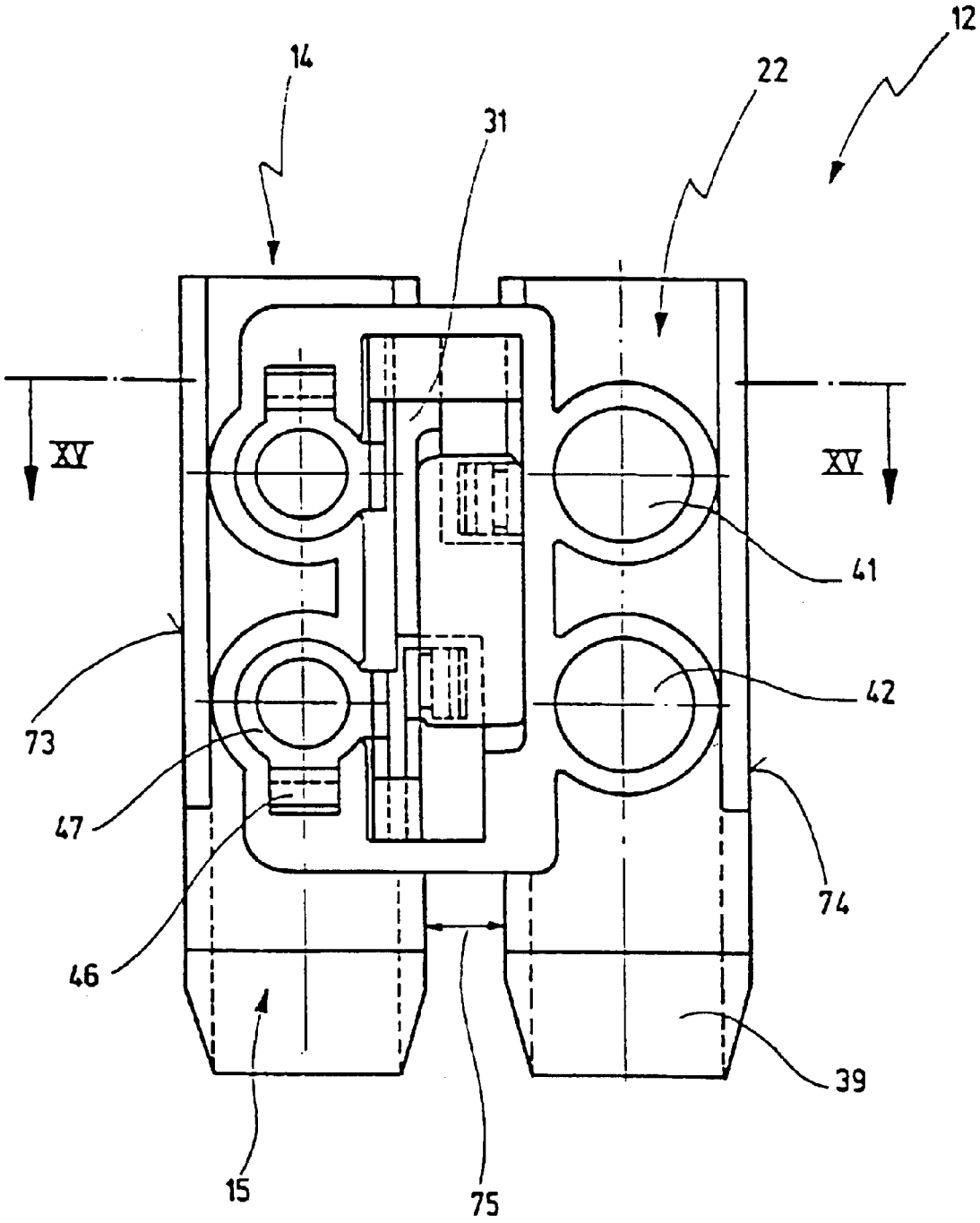
FIG. 14 shows a plan view of a connection terminal as in FIG. 2 but with a receptacle arranged at the centre.
Figure 15:
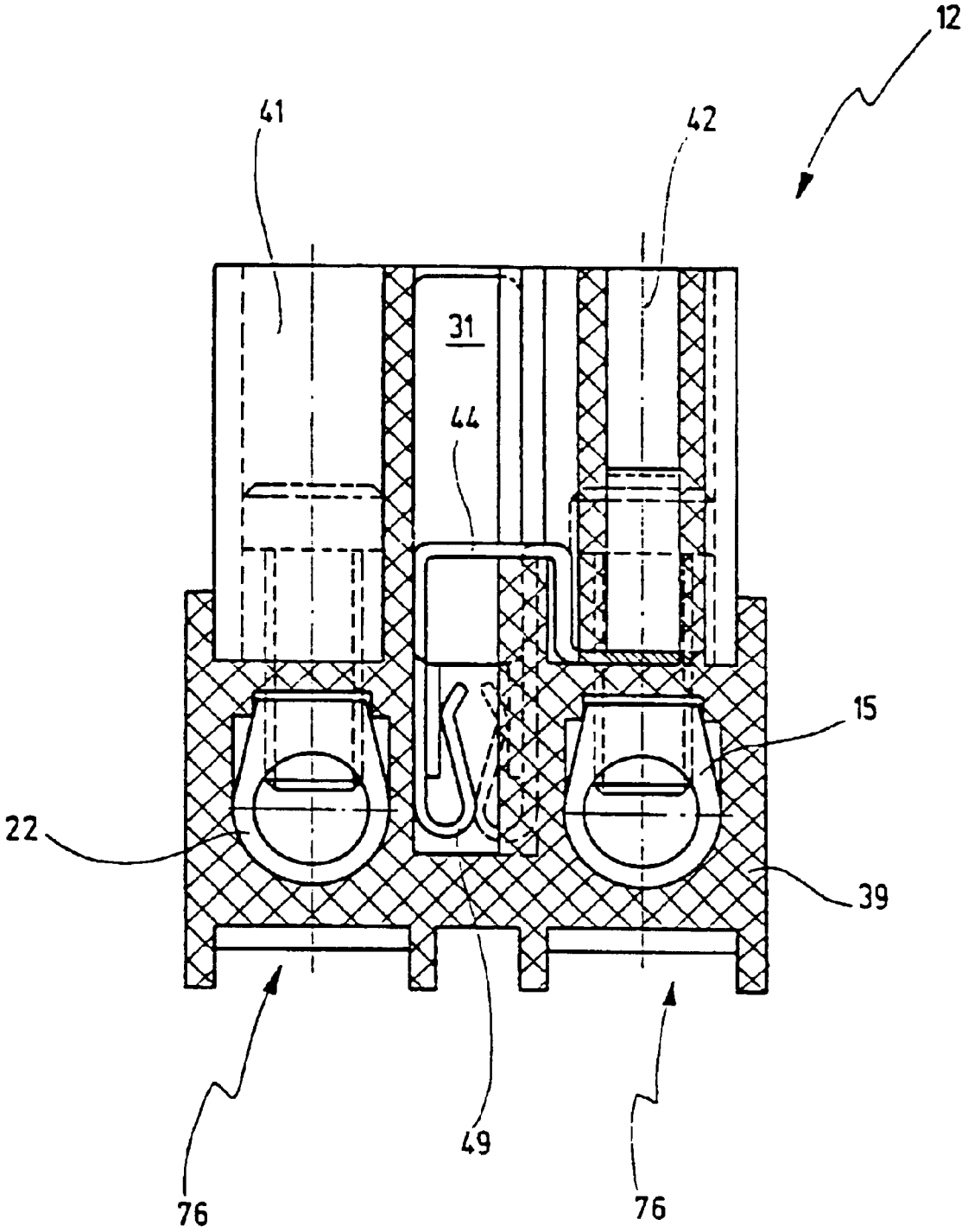
FIG. 15 shows a cross-sectional view of the connection terminal of FIG. 14; seen along the line XIV—XIV in FIG. 14.

FIGS. 14 and 15 show a plan view and a cross sectional view, respectively, of a further embodiment of the connection terminal, where the clamping blocks 14, 15 are provided on a first side 73 and a connection part 22 is provided on a second side 74, the receptacle 31 being arranged between the two sides 73, 74, which receptacle in the previous embodiments was always located at the side 73. A gap 75 is formed in the insulating casing 39 due to the arrangement shown in FIGS. 14 and 15.

As can be seen in FIG. 15, lower guide channels 76 are provided on the insulating casing 39 through which the connection terminal 12 can be secured to a housing 11 of an electrical device 10 to be protected.

Figure 16:
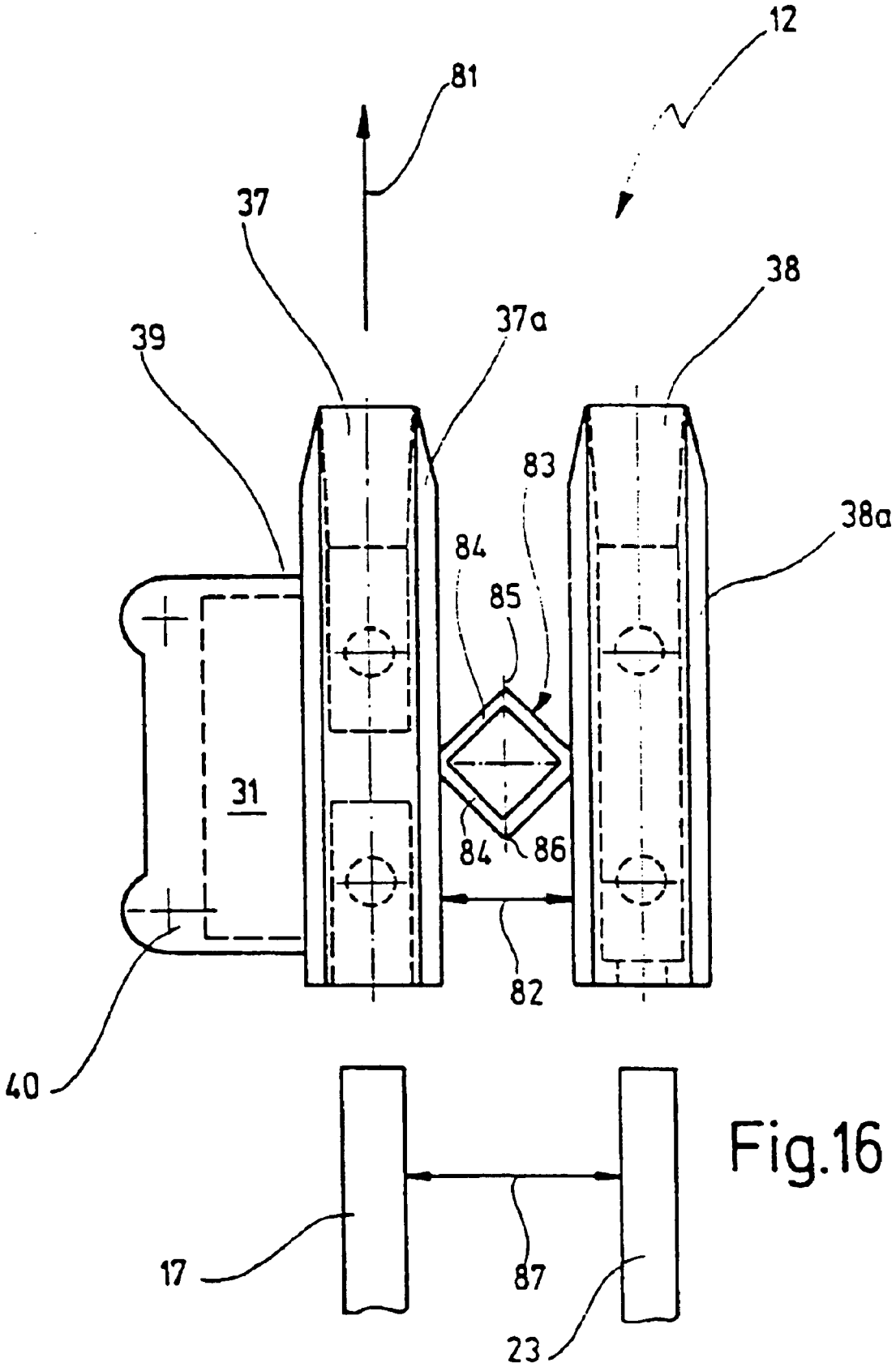
FIG. 16 shows a bottom view of the casing in FIG. 2.

Finally, FIG. 16 shows a bottom view of the insulating casing 39 of FIG. 2, where in contrast to the embodiment of FIG. 15, the receptacle 31 is not located between the casing sections 37*a*, 37*b*, but in the cuboid 40 at the left side of the casing section 37*a*.

As can be seen in FIG. 16, the channels 37, 38 run in longitudinal direction, indicated at 81, of the rectangular shaped casing sections 37*a*, 38*a*, where a spacing 82 is formed transversely to the longitudinal direction 81 between the two casing sections 37*a*, 38*a*. This spacing 82 is spanned by a flexible spacer 83, which connects the two casing sections 37*a*, 38*a* with one another such that the spacing 82 can be made larger or smaller.

In the illustrated embodiment of FIG. 16, the spacer 83 comprises two webs 84, which form a kind of a diamond shape and their tips 85, 86 point away from one another in the longitudinal direction 81. When the spacing 82 is altered, the tips 85, 86 move correspondingly toward or away from one another. It will be understood that several such spacers 83 can be provided between the casing sections 37*a*, 38*a*.

With the flexible variation of the spacing 82, the connection terminal 12 can be used to connect lines 17, 23, whose spacing 87 varies due to manufacturing tolerances or the type of construction. Thus only one connection terminal 12 is necessary to be able to connect lines 17, 23 having different spacings 87.

Should the connection terminal 12 be designed to connect three pairs of lines, as indicated schematically in FIG. 1, a further casing section can be provided to the right of the section 38*a*, which can then also be connected to the casing section 38*a* with a flexible or deformable spacer.

Figure 17:
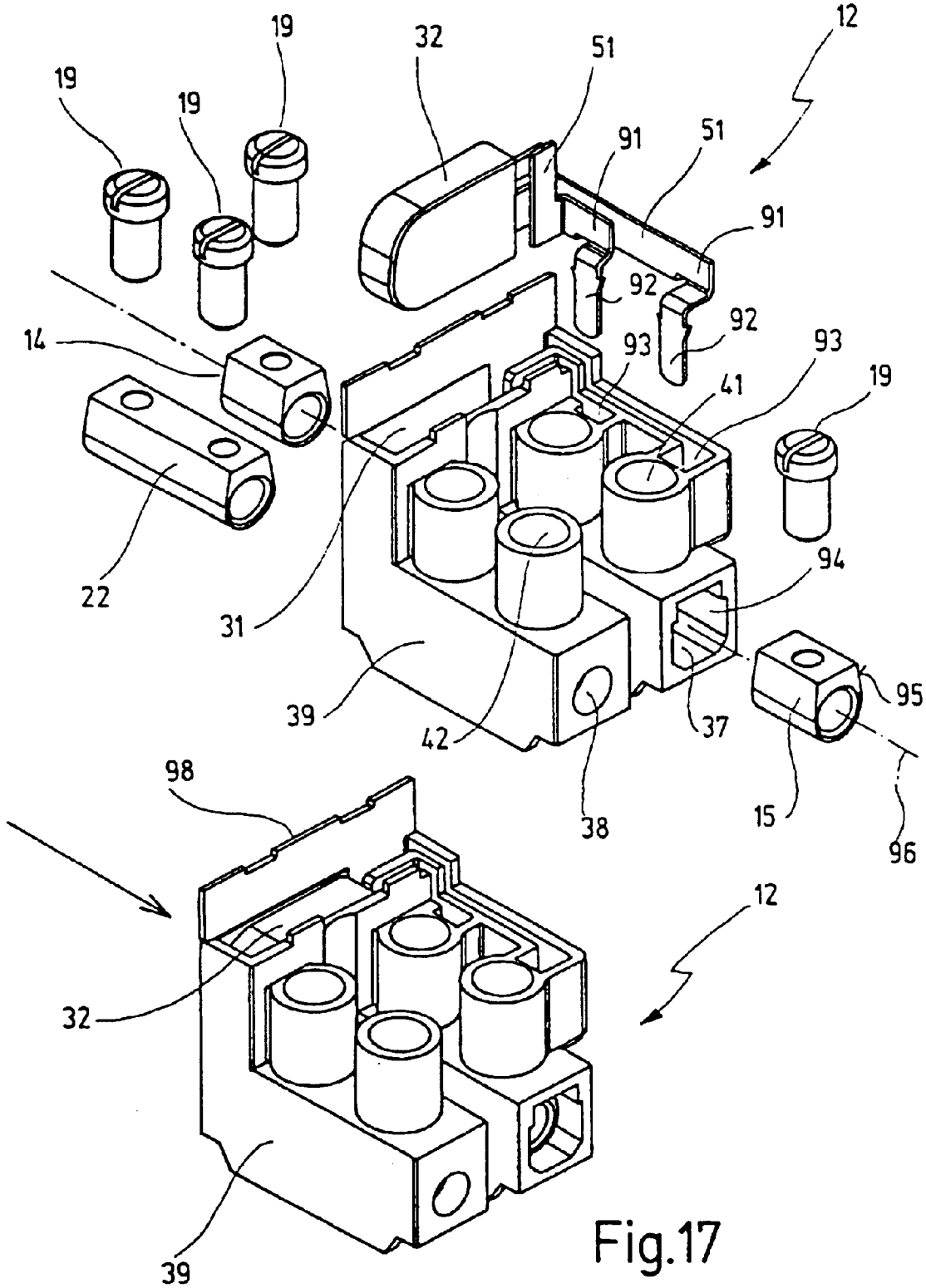
FIG. 17 shows a further embodiment of the invention in a view as in FIG. 2 with the temperature limiter being connected via fish joint strips with the clamping blocks.

FIG. 17 shows a further embodiment of the new connection terminal in an exploded view as in FIG. 2, where the same parts are indicated with the same reference numerals.

Each free end 91 of the terminal legs 51 of the temperature limiter 32 comprises a fish joint strip 92 that engage into slots 93 at the insulating casing 39 during insertion of the temperature limiter 32 so that they protrude into the channel 37. Beforehand, the clamping blocks 14, 15 are inserted into channel 37 so that the fish joint strips 32 are clamped between an inner wall 94 of channel 37 and an outer wall 95 of the respective clamping block 14, 15, thus establishing an electrical contact of the temperature limiter 32 to both clamping blocks 14, 15 that are electrically connected in this way.

In the channel 37 the clamping blocks 14, 15 are arranged along a longitudinal direction indicated by 96. In the embodiment as shown in FIG. 17 the receptacle 31 is located at the front end of the insulating casing 39 so that it extends transversely to the longitudinal direction 96.

At the bottom of FIG. 17 the connection terminal 12 is shown with mounted temperature limiter 32. Arrow 97 indicates where connection terminal 12 rests on an electrical device to be protected, namely with a front wall 98 that electrically separates the temperature limiter 32 from the device to be protected, but has only a small thickness so that, in toto, a good thermal coupling of the temperature limiter 32 to the device is achieved.

Figure 18:
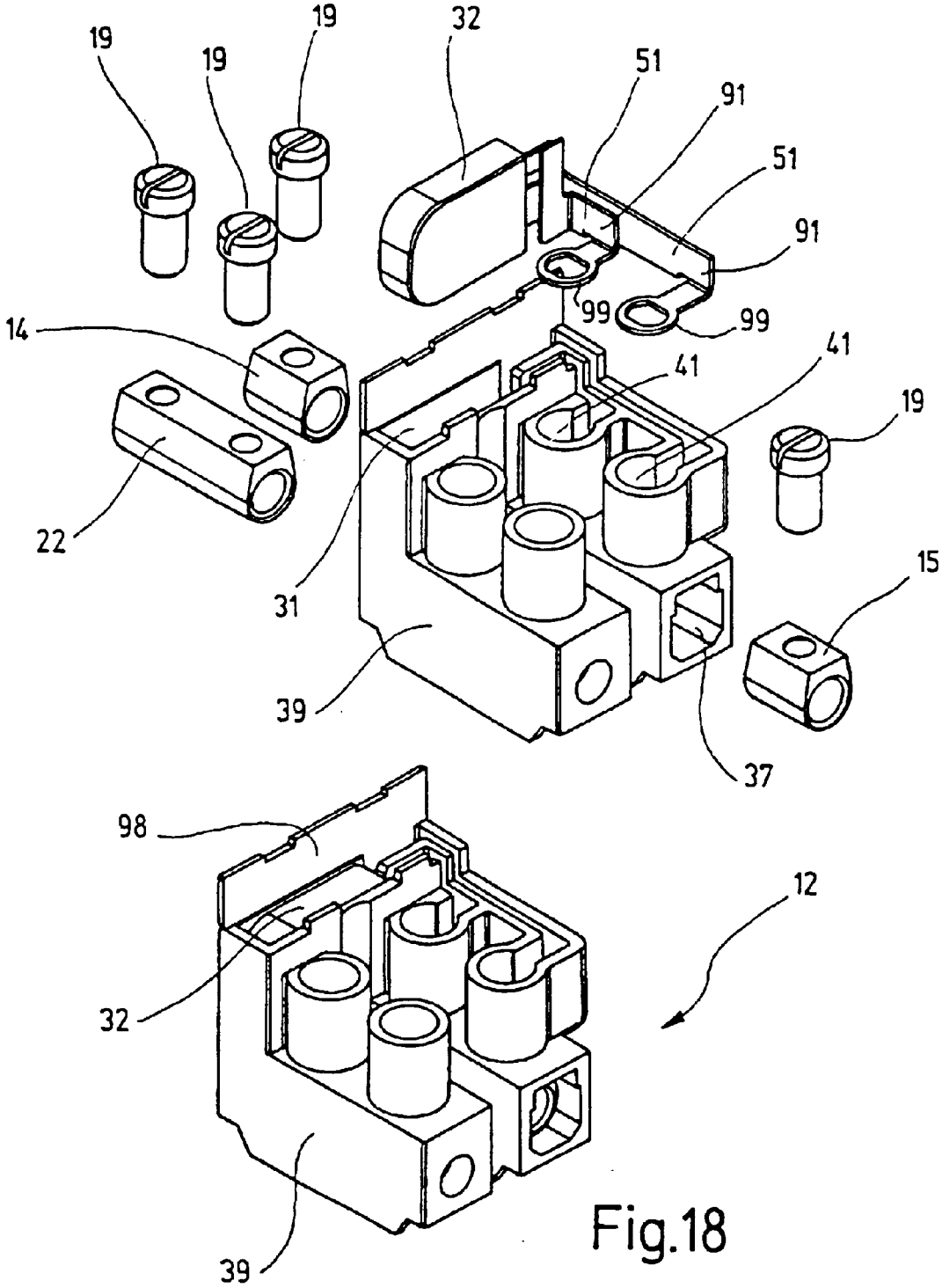
FIG. 18 shows a further embodiment in a view as in FIG. 17 with a temperature monitor being screwed to the clamping blocks via connector eyelets.

FIG. 18 shows the connection terminal 12 in a comparable embodiment as in FIG. 17, only the connection between the clamping blocks 14, 15 and the terminal legs 51 of the temperature limiter 32 is established in a different manner. As in FIG. 17, the terminal legs 51 are bent several times, but now their free ends 51 bear connector eyelets 99 that are placed in the two screw holes 41 in the frontal receptacle 31 during insertion of the temperature limiter 32.

The screws 19 are screwed through the screw holes 41, thereby passing through the eylets 91 and screwing into the clamping blocks 14, 15. The connector eyelets 99 have an inside diameter that is smaller than the diameter of the core of the thread of screws 19 so that the screws firmly cut into the connector eyelets 99 and therefore provide for good electrical connection between the screws and the terminal legs 51. When the screws are screwed into the clamping blocks 14, 15, an electrically conductive connection between the two clamping blocks 14, 15 through the screwed-in screws 19, the connector eyelets 99 and the temperature limiter 32 is achieved.

What I claim, is:

1. A connection terminal for connecting at least two lines, comprising a first clamping block to which a first line can be electrically and mechanically connected and a second clamping block to which a second line can be electrically and mechanically connected, wherein a receptacle is provided into which a temperature limiter comprising at least two terminals can be plugged in, and into which two connection elements extend, each being connected at its first end with one of the two clamping blocks and at its second end in contact with an associated terminal of a temperature limiter, when plugging in same in the receptacle, wherein an interruptable short circuit connection is provided between the two connection elements at their second ends, such that said second ends are interconnected with each other either via said short circuit connection or via said temperature limiter; and further comprising at least one connection cart having two clamping blocks directly connected to one another, through which two further lines can be directly connected to one another, and an insulating casing having a first casing section receiving the first and second clamping block and at least one second casing section receiving the at least one connection part, wherein a flexible spacer is provided between the two casino sections such that the two casing sections are laterally variable in their spacing to one another.

2. The connection terminal of claim 1, wherein the two connection elements at their second end each comprise a clamp contact for an associated terminal leg of the temperature limiter.

3. The connection terminal of claim 1, wherein at least one of the two clamping blocks comprises a retaining bore for receiving a line as well as a threaded hole running transversely to the retaining bore and provided for a screw for clamping the line in the retaining bore.

4. The connection terminal of claim 1, wherein the first and second clamping blocks are arranged in the insulating casing at a first side and the connection part is arranged at a second side, whereby the receptacle is arranged between the two sides.

5. The connection terminal of claim 1, wherein both clamping blocks are arranged along a longitudinal axis one after another and that the temperature limiter is received in a frontal receptacle extending transversely to the longitudinal axis.

6. The connection terminal of claim 1, wherein the temperature limiter is a PTC-element.

7. The connection terminal of claim 1, wherein the temperature limiter is a bimetal switch.

8. The connection terminal of claim 1, wherein the two connection elements each comprise at least one resilient element and the two resilient elements contact one another to establish the short circuit connection and can be separated from one another by the actuator member.

9. The connection terminal of claim 8, wherein each resilient element comprises a first contact region through which it forms the short circuit connection with the first contact region of the other resilient element, and a second contact region through which it rests against an associated terminal leg of a temperature limiter inserted into the receptacle.

10. The connection terminal of claim 1, wherein the short circuit connection comprises a short circuit element clamped between the connection elements and being movable into an open position by the actuator member.

11. A temperature limiter having an actuator member arranged thereon for use in a connection terminal according to claim 10.

12. An actuator member for use in a connector terminal according to claim 10.

13. The connection terminal of claim 1, wherein the two connection elements at their respective first ends are spring biased to rest against the respective clamping block.

14. The connection terminal of claim 13, wherein at least one of the two clamping blocks comprises a retaining bore for receiving a line as well as a threaded hole running transversely to the retaining bore and provided for a screw for clamping the line in the retaining bore.

15. The connection terminal of claim 14, wherein the connection elements each comprise an upstanding, resilient wing at its first end, which wing extends approximately parallel to the respective screw and rests under spring bias onto the screw.

16. An electrical device having a connection terminal according to claim 1.

17. The electrical device of claim 16, wherein the connection terminal is secured on its housing.

18. The electrical device of claim 16, wherein the connection terminal with its insulating casing is formed integrally with the housing.

19. The connection terminal of claim 1, wherein the short circuit connection can be interrupted by an actuator member insertable into the receptacle.

20. An actuator member for use in a connector terminal according to claim 19.

21. The connection terminal of claim 19, wherein the actuator member is arranged on the temperature limiter.

22. A temperature limiter having an actuator member arranged thereon for use in a connection terminal according to claim 21.

23. The connection terminal of claim 19, wherein the actuator member is a breaker pin which is insertable into the receptacle so as not to be removable.

24. The connection terminal of claim 23, wherein the breaker pin is insertable into the receptacle in a force fit.

25. A connection terminal for connecting at least two lines, comprising a first clamping block to which a first line can be electrically and mechanically connected and a second clamping block to which a second line can be electrically and mechanically connected, wherein a receptacle is provided into which a temperature limiter comprising at least two terminals, preferably two terminal legs, can be plugged in, and into which two connection elements extend, each being connected at its first end with one of the two clamping blocks and at its second end, preferably automatically, contact a terminal, preferably an associated terminal leg of a temperature limiter, when plugging in same in the receptacle, comprising at least one connection part having two clamping blocks directly connected to one another, through which two further lines can be directly connected to one another, and comprising an insulating casing having a first casing section receiving the first and second clamping block and at least one second casing section receiving the at least one connection part, wherein a flexible spacer is provided between the two casing sections such that the two casing sections are laterally variable in their spacing to one another.

26. An electrical device having a connection terminal according to claim 25.

27. The electrical device of claim 26, wherein the connection terminal is secured on its housing.

28. The electrical device of claim 26, wherein the connection terminal with its insulating casing is formed integrally with the housing.

* * * * *

UNITED STATES PATENT AND TRADEMARK OFFICE

CERTIFICATE OF CORRECTION

PATENT NO. : 6,764,356 B2
DATED : July 20, 2004
INVENTOR(S) : Michael Becher et al.

It is certified that error appears in the above-identified patent and that said Letters Patent is hereby corrected as shown below:

Column 13,
Line 39, “cart” should be -- part --.
Line 46, “casino” should be -- casing --.

Signed and Sealed this

Fourteenth Day of December, 2004

JON W. DUDAS
*Director of the United States Patent and Trademark Office*